United States Patent [19]

Sronce

[11] Patent Number: 4,754,797

[45] Date of Patent: Jul. 5, 1988

[54] TWO WAY ANIMAL DOOR AND FRAME

[76] Inventor: Robert M. Sronce, 27795 Ave. Hopkins, Valencia, Calif. 91355

[21] Appl. No.: 2,829

[22] Filed: Jan. 13, 1987

[51] Int. Cl.[4] ..... E06B 7/28

[52] U.S. Cl. ..... 160/354; 160/180; 49/169

[58] Field of Search ..... 160/354, 368, 370, 392, 160/395, 179, 180, 369, 181, 116; 49/168, 169, 170, 171

[56] References Cited

U.S. PATENT DOCUMENTS

| | | | |
|---|---|---|---|
| 2,758,646 | 8/1956 | Johnson | 160/354 |
| 3,464,158 | 9/1969 | Greene | 160/180 X |
| 3,654,733 | 4/1972 | Blackwell | 49/168 |
| 3,690,299 | 9/1972 | Johnson | 160/354 X |
| 3,797,554 | 3/1974 | Johnson | 160/354 |
| 3,985,174 | 10/1976 | Bricker | 160/180 |
| 4,043,079 | 8/1977 | Smith | 49/169 X |
| 4,047,331 | 9/1977 | Davlantes | 49/171 |
| 4,053,007 | 10/1977 | Griffith | 160/180 |
| 4,603,724 | 8/1986 | Borwick | 160/180 |
| 4,651,793 | 3/1987 | Davlantes | 160/116 X |

*Primary Examiner*—Ramon S. Britts
*Assistant Examiner*—David M. Purol
*Attorney, Agent, or Firm*—Jessup, Beecher & Slehofer

[57] ABSTRACT

A two-way animal door and frame having an outside frame and an inside frame is adapted to fit over a cut out opening in a door or a wall for allowing passage of a pet through a pliant door and border so that the pliant door and border will seal off the opening when not in use to prevent cold air and the like from entering the house. The upper ends of the pliant door and pliant U-shaped border are attached to one of the frames by a peg-and-hole securement. The two frames fit flush to their respective side of the door or wall and are secured to each other by nuts and bolts to keep both frames in place and for pushing the edges of both frames and the pliant door and border flush against the door or wall.

4 Claims, 2 Drawing Sheets

TWO WAY ANIMAL DOOR AND FRAME

BACKGROUND OF THE INVENTION

1. Field of the Invention

The present invention pertains to closures, partitions and panels, flexible and portable.

2. Description of the Prior Art

This pet door invention is an improvement over the "pet door structure" disclosed in U.S. Pat. No. 3,797,554, patented on Mar. 19, 1974, by Frances H. Johnson. Said patent retains the upper portion of the flexible door 38 by means of several spaced protuberances No. 40. These protuberances are held in place by the elongated opening formed by the cane-shaped cross section at 34. After a period of continuous usage by the animal passing through the door, the securing area shown in FIG. 4 of Johnson becomes worn and begins to tear necessitating the replacement of the door 38 and/or the border element 44. The door structure has to be dismantled in order for the end of the door and border element to be slid off the elongated opening 36 before replacing the door and the border by sliding the replacement parts therethrough. The present invention improves upon this securing and replacement means in that the upper portions of the border and the door are held in place by a peg-and-hole means and further that the faces of these upper portions are flush with the edge of the frame and further that when installed, the faces are flush against the door above the opening providing for a snug, tight seal.

SUMMARY OF THE INVENTION

This invention relates to a two-way animal door and frame which can be installed over a cut out opening in a door or in a room. Overall there are four components which, when assembled, comprise the invention. They are:

1. a first rigid rectangular frame having a rectangular opening cut out therein;
2. a second rigid, rectangular frame having a larger rectangular opening cut out therein;
3. a pliant door attached to the first frame by means of a peg-and-hole attachment;
4. a pliant border which seals between the pliant door and the rectangular opening of the rigid frames, and also attached to the first frame by means of a peg-and-hole attachment.

The first and second frames can be made out of plastic, and can be fabricated by the plastic molding process. The pliant door and pliant border are also made from a rubberlike flexible compound which could be also fabricated by means of a plastic injection molding process. The door is installed on either an outside door or wall of a dwelling of some type. The purpose of the pet door is to allow the occupant's pet to freely migrate from the inside to the outside of the house without requiring the pet's owner to open a closed door to let the pet in or out. The door is installed by using the second frame with the larger rectangular opening as a template. The frame is placed against the door at the correct height for the animal and the rectangular opening is traced out. Each of the four corners are then drilled out large enough so that a keyhole saw can be fitted therein to cut the four sides forming the cutout opening in the door. Thereafter, the first frame has a protruding lip extending from the rectangular opening so that it will fit into the opening cut out in the door.

The appropriate marks for the holes to be drilled for the bolts and acorn nuts can be marked by means of a pick or other marking instrument of some type; the holes are then drilled through the door. The assembled other three components of the door; the first rectangular frame, the pliant door and the border are positioned on the outside of the door and the bolts are passed through the drilled holes made in the door and the holes in the two sections and the acorn nuts are then tightened down. The interior frame and the exterior frame are eventually compressed together so that both faces are flush against each respective face of the door. As the first frame is being pressed against the outside of the door, the upper portions of the door and border are pressed flush against the door by the frame giving a nice tight seal above the cut out opening. The door is normally installed so that the frame having the larger opening is installed on the inside of the door, because the outside frame prevents the pliant border from swinging into the opening giving a greater seal against gusts of wind and the elements outside. To increase the sealing from the outside elements, there is also provided an added rigid sliding door. There are guides on both sides of both frames so that this sliding door can be slid down over the opening to cover and seal it off. Also, at the horizontal top area of both frames there are two stop means which prevent the sliding door from sliding up unless one of these stop means is depressed to let the edge of the sliding door pass by and off the frame. Of course, when the sliding door is in place, the pet cannot travel through the door. This is a safety feature whenever the occupant is away on vacation or whenever there is inclement weather outside and the occupant desires the pet door to be sealed off.

The upper portion of the pliant door and the bitter ends of the upper portion of the U-shaped border are securely attached by means of a peg-and-hole combination. The periodic traversing of the pet through the door eventually weakens the anchoring area of the pliant door and border. Eventually the bending causes so much stress on the upper portion, that the door tears away and has to be replaced. The replacement of the door and pliant border is a relatively easy task. The series of bolts and acorn nuts simply have to be unscrewed and the first frame section, which is on the outside, can be pulled away from the bolts, the old door and border can be removed and the replacement door and border can be replaced on the peg-and-groove parts of the frame. Then it is a simple matter of sliding the first frame back over the protruding bolts and retightening the acorn nuts.

DETAILED DESCRIPTION OF THE PREFERRED EMBODIMENT

Figure 1:
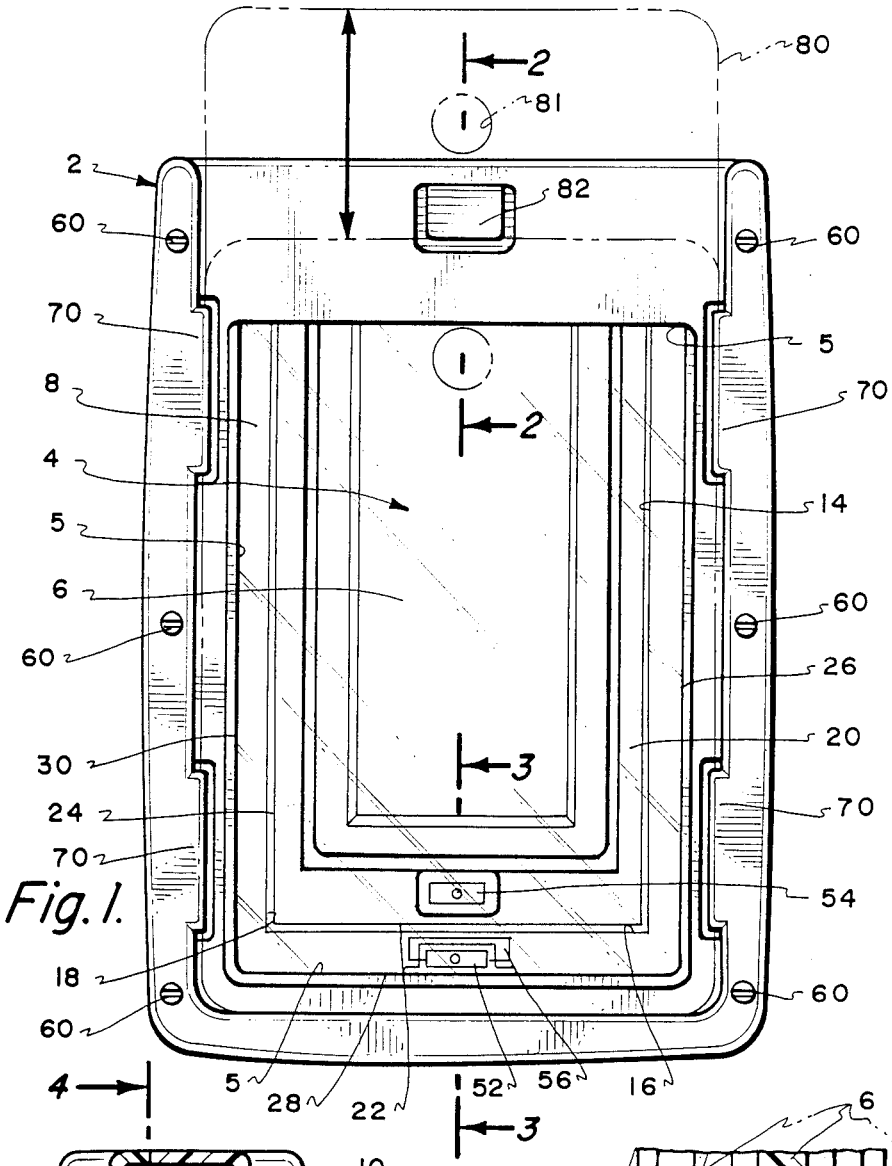
FIG. 1 is a front elevational view of the pet door showing the inside second frame, pliant door, and U-shaped border.

FIG. 1 illustrates one section of the pet door installed over a previously cut out opening in an outside door or wall. The overall circumference of the pet door defines a first frame and a second rigid rectangular frame 2. Directly behind this frame 2 and positioned on the other side of the door or wall is a first frame similar to the second frame 2, which can only partially be seen in FIG. 1. The other figures, however, do illustrate sections of the first frame labeled 10. The rigid rectangular frame 2, illustrated in FIG. 1, has a rectangular opening 4 which is slightly smaller than opening cut out of the door or wall. This rectangular opening 4 is sufficiently large to allow the pliant or flexible door 6 to bend inwardly or outwardly through this rectangular opening. There is also illustrated in FIG. 1 a generally U-shaped pliant border 8 for covering the gap between the pliant door 6 and the edges of the rectangular opening 4. Clearance is provided to allow the U-shaped border to swing or bend inwardly, whenever the pet is entering from the outside of the house.

Figure 2:
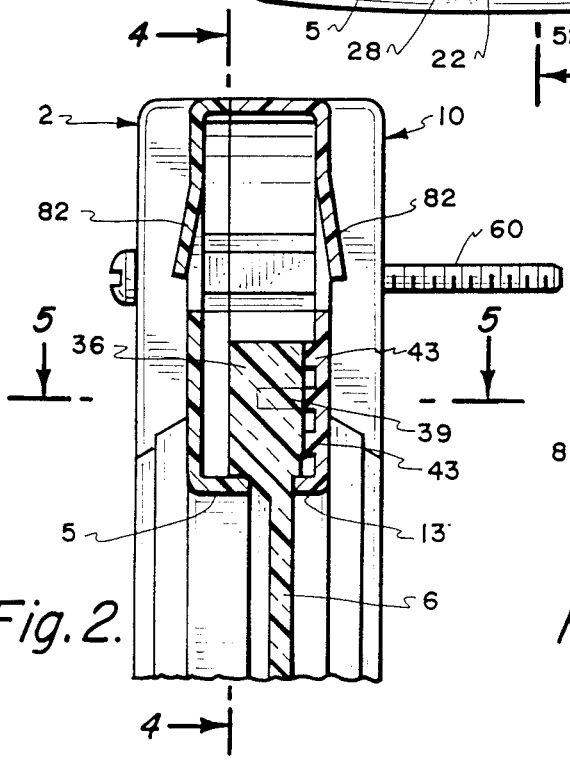
FIG. 2 is a fragmentary cross sectional view taken along the lines 2—2 of FIG. 1.
Figure 3:
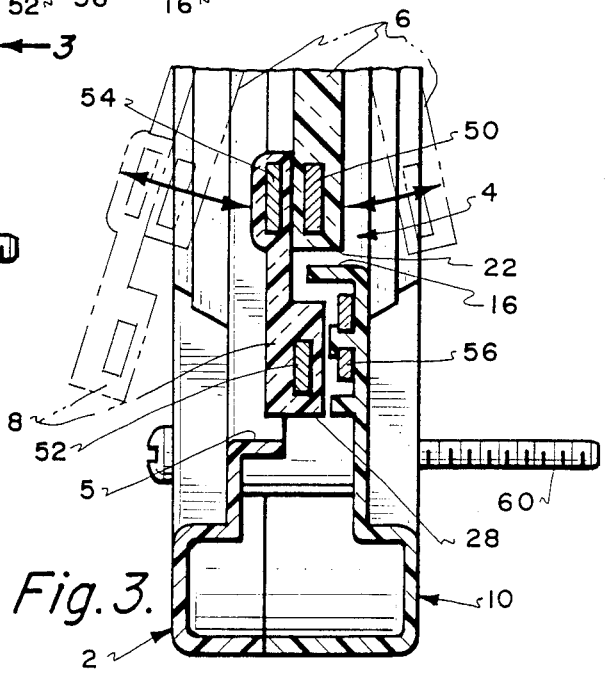
FIG. 3 is a fragmentary cross sectional view of the pet door taken along the lines 3—3 of FIG. 1.
Figure 4:
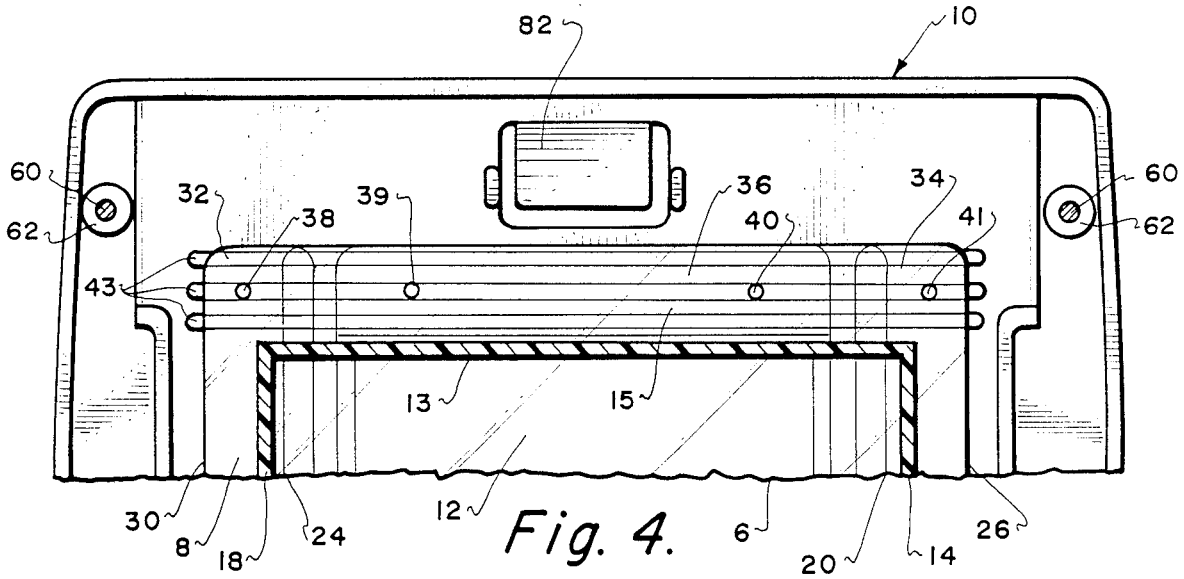
FIG. 4 is a fragmentary front elevational view taken along the lines 4—4 of FIG. 2 and showing the peg-and-hole means of the bitter ends of the U-shaped border and the pliant door attached to the outside first frame.
Figure 5:
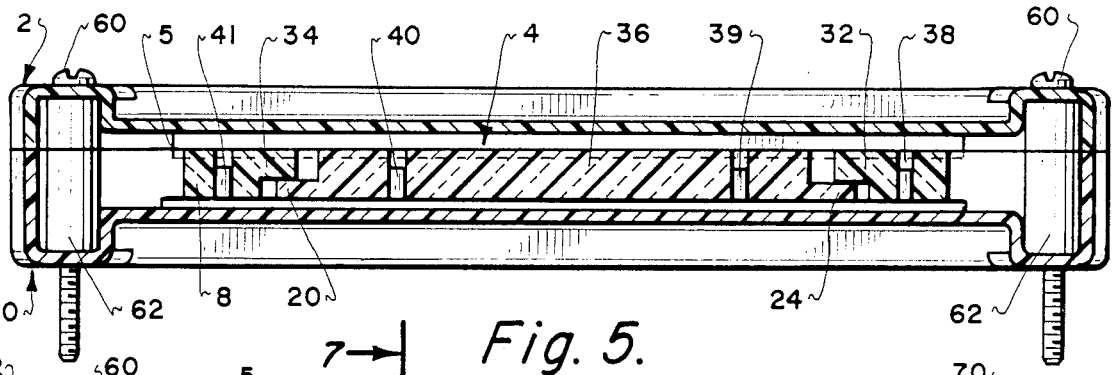
FIG. 5 is a top cross sectional view taken along the lines 5—5 of FIG. 2 showing the first frame and the second frame and the bitter ends of the U-shaped border and pliant door attached to the peg and hole of the first frame.
Figure 6:
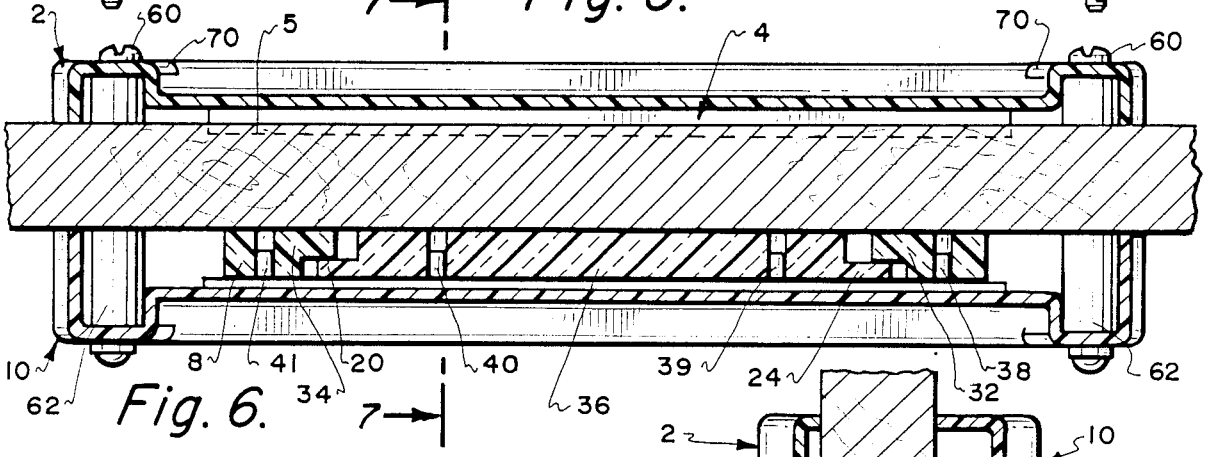
FIG. 6 is similar to the cross sectional view of FIG. 5, additionally having the cross section of the door shown and as the invention would be positioned on either side of the door in a typical installation.
Figure 7:
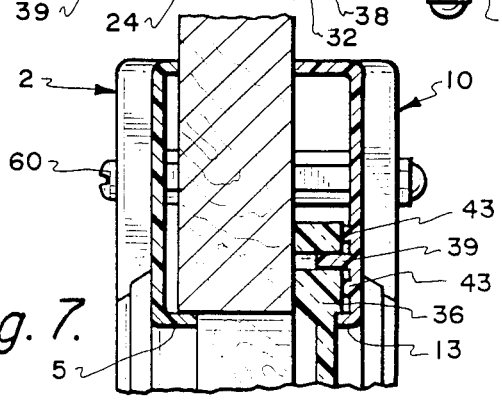
FIG. 7 is the cross sectional view taken along the line 7—7 of FIG. 6.

The first frame 10 has an upper, horizontal member constituting a first mounting means, and a substantially rectangular opening therein through which a pet animal may pass. This rectangular opening is labeled as 12. FIG. 4 shows the top edge 13 of the opening 12. This opening 12 is smaller than the opening 4 of the second frame. The opening 12 is wide enough to allow the pliant door 6 to pass through the smaller opening 12. However, the pliant border 8 is wider and cannot pass through the smaller, rectangular opening 12. The cross sectional view of FIG. 3 shows the lower edge of opening 4 which is a protruding lip 5 in relationship to the lower edge of opening 12. The protruding lip extends from the entire perimeter of the opening 4 of frame 2. As can be seen, there is roughly a 1 inch height differential between the lower edges of the two openings. The cross sectional view of FIG. 2 shows the upper edge (protruding lip 5) of opening 4 and the upper edge 13 of opening 12, indicating that the two upper edges of both openings oppose each other. The cross sectional views of FIG. 5 and FIG. 6 shows the protruding lip 5 of the larger opening 4. The pliant door 6 and the U-shaped border 8 are translucent and accordingly the outline of smaller opening 12 is visible in FIG. 1. The outline is numbered 14, 16 and 18. As previously stated, the upper top horizontal edge of both openings are the same. In FIG. 1, the right vertical edge of the smaller opening 12 is labeled 14. The bottom horizontal edge of the opening 12 is labeled 16 and the left vertical edge of the smaller opening 12 is labeled 18. The right vertical edge of the pliable door 6 is labeled 20, the bottom horizontal edge of the pliant door is labeled 22 and the left vertical edge of the pliant door is labeled 24. As can be seen in FIG. 1, the perimeter of the pliant door is slightly smaller than the perimeter of the smaller opening 12, thereby allowing the pliant door 6 to bend through the pet door, either inwardly or outwardly. The right vertical edge of the U-shaped pliant border is labeled 26, the bottom horizontal edge of the U-shaped pliant border is labeled 28 and the left vertical edge of the U-shaped pliant border is labeled 30. As can be seen in FIG. 1, the outer edge of the pliant border overlaps both the edges of the door and the smaller opening 12, thereby serving as a seal or gasket. The three sides of the U-shaped pliant border is slightly smaller than the perimeter 5 of the large opening 4.

The relationship between the upper horizontal portion above the edge 13 of the smaller opening 12, the pliant border and the pliant door will now be discussed. The pliant door 6 has a horizontal upper edge portion 36 extending adjacent the upper horizontal member 15 of the first frame 10. The portion 36 constitutes part of a second mounting means. The upper end parts 32 and 34 of the border 8 also extend upwardly and are adjacent to the member 15 and to the upper edge portion 36 of the door. These end parts also constitute a part of the second mounting means. As can be seen, there are four pegs 38, 39, 40 and 41 and complementing these four pegs are four circular holes also labeled 38′, 39′, 40′ and 41′ in the upper edge portion 36 of the door and the upper end parts 32 and 34 of the border 8. The circular holes and the four pegs fit together to form a peg and hole means for securing the upper end parts to the upper frame portion 15 and also for securing the upper edge portion of the door. The cross sectional view of FIG. 5 clearly illustrates this relationship. As can be seen, the surfaces of the first frame, the door and the border all lie in a plane flush with the edges of the first frame 10. This flush fitting characteristic is for placement of the upper frame area 15 against the area of the door or wall above the cut out opening. The upper portion lies above the upper edge of the cut out and the pliant door and border are held in place.

FIG. 4 shows the upper mounting surface of the first frame 10. Additionally, FIGS. 5 and 6 also show the mounting surface of the first frame 10. The mounting surface lies substantially in a plane and is adapted to be placed flush against the room door or wall circumjacent the opening cut out therein. The surfaces of the door 6 and the border 8 which face away from frame 10 also lie substantially in the same plane that the mounting surface of the frame 10 lies in. This can also be seen in FIGS. 5 and 6 where the surfaces of the door 6, the border 8 and the first frame 10 lie substantially in the same plane and flush against the door or wall. The upper portion of the frame 10 has a plurality of parallel ribs 43 supporting the pegs 38, 39, 40 and 41. The ribs provide a flat pressing surface and also additional rigidity to the already rigid rectangular frame 10. The pegs can be of the same length as the width of either the bitter ends 32 and 34 of the border or the upper portion 36 of the door. The only requirement of the pegs is that they have sufficient length to be able to support both the door and the border. In the embodiment shown in FIGS. 4 through 7 the pegs are on the frames, and the holes are in the bitter ends of the border and the upper portion of the door flap. However, this relationship could be reversed by having the peg means extending from the surfaces of the bitter ends 32 and 34 and the door portion 36 which face away from the frame 10 and having holes or cavities placed in the rib area 43 for receiving the pegs.

FIGS. 1 and 3 illustrate embedded magnets near both the lower horizontal edge 28 of the border and also on the lower horizontal edge 22 of the door. The cross sectional view of FIG. 3 illustrates these magnets identified as follows:

No. 50 indicates the embedded magnet near the bottom edge 22 of the door 6.

No. 52 identifies the lower magnet near the lower edge 28 of the border.

No. 54 identifies the upper magnet of the border.

Furthermore, there is a fourth magnet identified as 56 which is secured to the lower inside edge 16 of the smaller opening 4. The magnets are for the purposes of assisting in the sealing of the rectangular opening 4 by providing a resistance to wind pressure by the attraction between the two magnets whenever a gust of wind or outside weather conditions put pressure on the door flap to cause it to bend inwardly. The phantom views in FIG. 3 further illustrate the fact that the door 6 and border 8 can swing inwardly but that only the door 6 can swing outwardly. Again, this is because the smaller opening 4 in the first frame 10 prevents this.

The invention could be installed without the second frame 2. This could be accomplished by having the cut out portion of the door or wall the same as before but only having the first rectangular rigid frame 10 placed against one side of the door leaving the other side of the door unfinished, so to speak. The frame 10, the door 6 and the border 8 could all be placed flush adjacent the outside of the door or wall and slightly above the upper edge of the cut out opening. The frame could be secured to the door wall by wood screws of some type. Alternatively the first frame 10, the door 6 and the border 8 could be attached to the inside surface of the door. However, having the first frame 10, door 6, and border 8 secured to the outside of the door or wall is the preferred method of installation. In this configuration, as indicated in FIG. 3, the border and door must both bend inwardly into the interior of the house. This also creates the most resistance to the wind.

The second frame 2 is provided for safety and aesthetic reasons, since this covers the edges of the cut out opening from the inside. The rectangular opening 4 is slightly smaller than the cut out opening—it also has the protruding lip 5 extending into a portion of the cutout, as shown in FIG. 5, thereby to give a finished look to the pet door opening and also to prevent the pet from scraping itself while going in or out through the door.

There are several sets of nuts and bolts identified as 60 around the perimeter of both frames. Additionally, there are bolt posts 62 on the insides of both frames to provide rigidity to the frame. The long bolts are for connecting the two frames between any door or wall which have a variety of widths. After the door size for the installation has been predetermined, the ends of the bolts can be hack-sawed off and the acorn nut bolts on the other end can be secured down to provide a nice finished look to the completed installation.

Both frames 2 and 10 have a series of vertical guide means 70 on either side of the openings 4 and 12. These guide means are two flanges on either side of the opening which provide for a removable sliding door 80 to be inserted therein. FIG. 1 shows in phantom lines, a portion of the sliding door which is generally a rectangular shape having a finger hole 81 and made of particle board or plastic of some type. The sliding door is cut sufficiently large enough to seal off either rectangular opening 4, or opening 12. Additionally, since either frame 2 or 10 has the identical guide means, the sliding door can be placed in either part of the pet door facing inside or outside. The sliding door is a further backup to seal off and keep out the elements in cold or rainy weather whenever the pet door does not need to be used for awhile. Along the horizontal upper portions of both frames 2 and 10 there are stop means shown as two depressible tabs which are labeled as 82 and can be clearly seen in cross section in FIG. 2. These stop means allow the sliding door 80 to be slid into place but which will prevent it from sliding up unless the appropriate stop means is depressed to allow the door to be slid past it.

While the present invention has been shown and described herein in what is conceived to be the best mode contemplated, it is recognized that departures may be made therefrom within the scope of the invention which is therefore not to be limited to the details disclosed herein, but is to be afforded the full scope of the invention.

What is claimed is:

1. A pet door adapted to be placed over an opening in a room door or wall, comprising:

a relatively rigid, substantially rectangular first frame having a mounting surface lying substantially in a plane and adapted to be placed flush against a room door or wall, circumjacent an opening therein;

said frame having first mounting means in the form of an upper, horizontal member and a substantially rectangular opening therein through which an animal may pass;

a pliant door having a width slightly smaller than said frame opening, and having an upper edge portion extending adjacent said horizontal member of said frame;

a generally U-shaped pliant border for covering the gap between said door and said frame opening and having upper end parts;

said upper edge portion and said upper end parts constituting second mounting means;

the upper end parts of said border extending upward adjacent said horizontal member of said frame;

a plurality of holes in one of said mounting means, and a corresponding plurality of pegs on the other of said mounting means extending into said holes, for securing together said two mounting means;

placement of said frame flush against the room door or wall serving to hold said door and said border in place on said frame.

2. The pet door as recited in claim 1 further comprising a second relatively rigid, substantially rectangular frame having a mounting surface lying substantially in a plane and adapted to be placed flush against a room door or wall, circumjacent an opening therein, said placement being superimposed with said first rectangular frame;

said frame having a substantially rectangular opening slightly larger than said U-shaped pliant border;

connecting means for securing said first and second frame with the door or wall therebetween.

3. The pet door as recited in claim 2 further comprising a removable sliding door for sealing off said rectangular opening;

said first and second frame means having vertical guide means for allowing said sliding door to cover said first frame opening or said second frame opening.

4. The pet door as recited in claim 3 further comprising;

stop means on said first frame and said second frame for preventing the removal of said sliding door unless said stop means is pressed.

* * * * *